United States Patent [19]

Foster et al.

[11] Patent Number: 4,592,104

[45] Date of Patent: Jun. 3, 1986

[54] HOSPITAL BED

[75] Inventors: L. Dale Foster, Brookville; William H. Peck, Oldenburg, both of Ind.

[73] Assignee: Hill-Rom Company, Inc., Batesville, Ind.

[21] Appl. No.: 558,460

[22] Filed: Dec. 6, 1983

[51] Int. Cl.[4] ..... A61G 7/06

[52] U.S. Cl. ..... 5/66; 5/60; 5/63; 5/68; 5/425

[58] Field of Search ..... 5/60–69, 5/425, 430, 508, 509; 269/322–325

[56] References Cited

U.S. PATENT DOCUMENTS

| | | | |
|---|---|---|---|
| 2,699,688 | 1/1955 | Sutton | 5/69 |
| 3,005,999 | 10/1961 | Brown | 5/67 |
| 3,045,256 | 7/1962 | Scher | 5/63 |
| 3,129,607 | 4/1961 | Schaefer | 5/68 |
| 3,428,307 | 2/1969 | Hunter et al. . | |
| 3,631,242 | 12/1971 | Williams | 5/66 |
| 3,633,901 | 1/1972 | Lindquist . | |
| 3,742,527 | 7/1973 | Johnston et al. . | |
| 3,798,684 | 3/1974 | Benoit et al. . | |
| 3,845,946 | 11/1974 | Warden et al. . | |
| 3,921,230 | 11/1975 | Hanning et al. | 5/66 |
| 4,061,324 | 12/1977 | Kvaerna et al. . | |
| 4,183,015 | 1/1980 | Drew et al. | 5/508 |
| 4,271,545 | 6/1981 | Christian, III | 5/66 |

FOREIGN PATENT DOCUMENTS 1048164 11/1966 United Kingdom .

OTHER PUBLICATIONS

Brochure, "Maquet—Heidelberg—S", 7 pages unnumbered, West Germany, Publication Date Unknown.

*Primary Examiner*—Gary L. Smith
*Assistant Examiner*—Michael F. Trettel
*Attorney, Agent, or Firm*—Burns, Doane, Swecker & Mathis

[57] ABSTRACT

A wheeled hospital bed is removably connectible to a drive unit. The bed comprises a plurality of articulated frame sections, a plurality of driven shafts, a linkage interconnecting the driven shafts and the frame sections for articulating the latter in response to rotation of the driven shafts, and a first guide structure. The drive unit includes a plurality of motors and drive shafts, and a second guide structure arranged to interact with the first guide structure of the bed when the bed is merged with the drive unit in order to orient the bed and drive units such that the drive and driven shafts are mutually aligned. The drive and driven shafts include a self-coupling mechanism for establishing a drive connection therebetween when in a merged condition. The drive unit may be anchored to the floor, or may be supported solely by the bed. In the former case, the bed can be rotatable about a vertical axis relative to the drive unit while maintaining connection therewith. The drive unit carries a pair of side guards which are arranged to straddle the bed. The side guards are connectible to an articulatable section of the bed so as to be movable therewith.

16 Claims, 16 Drawing Figures

FIG. 5
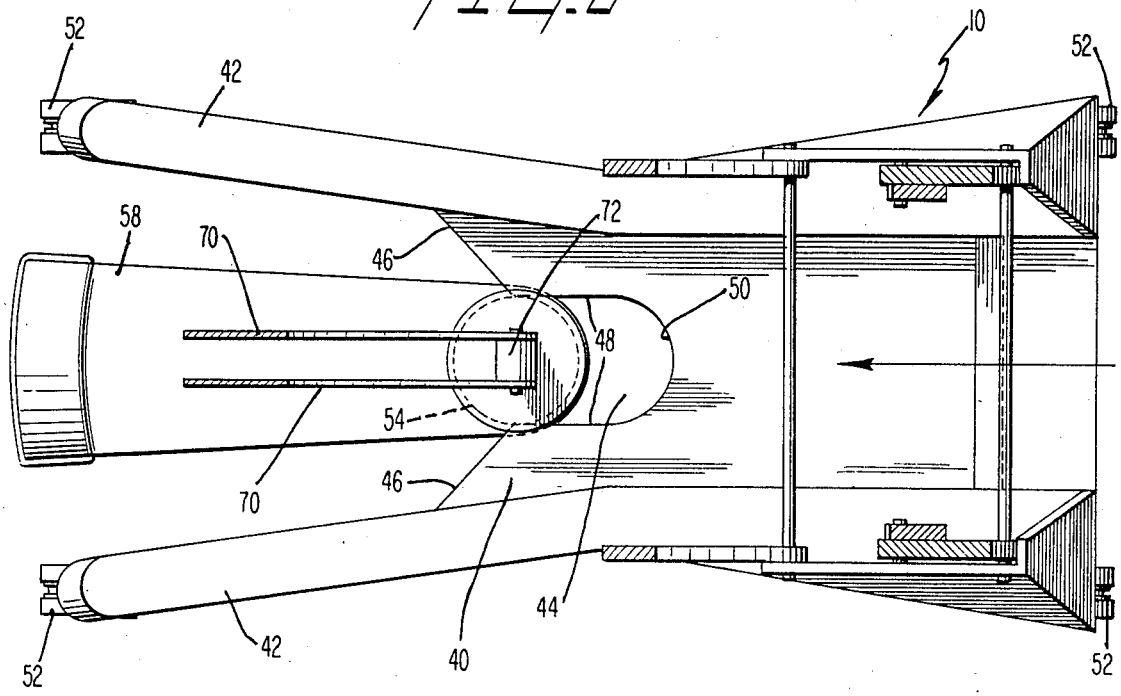
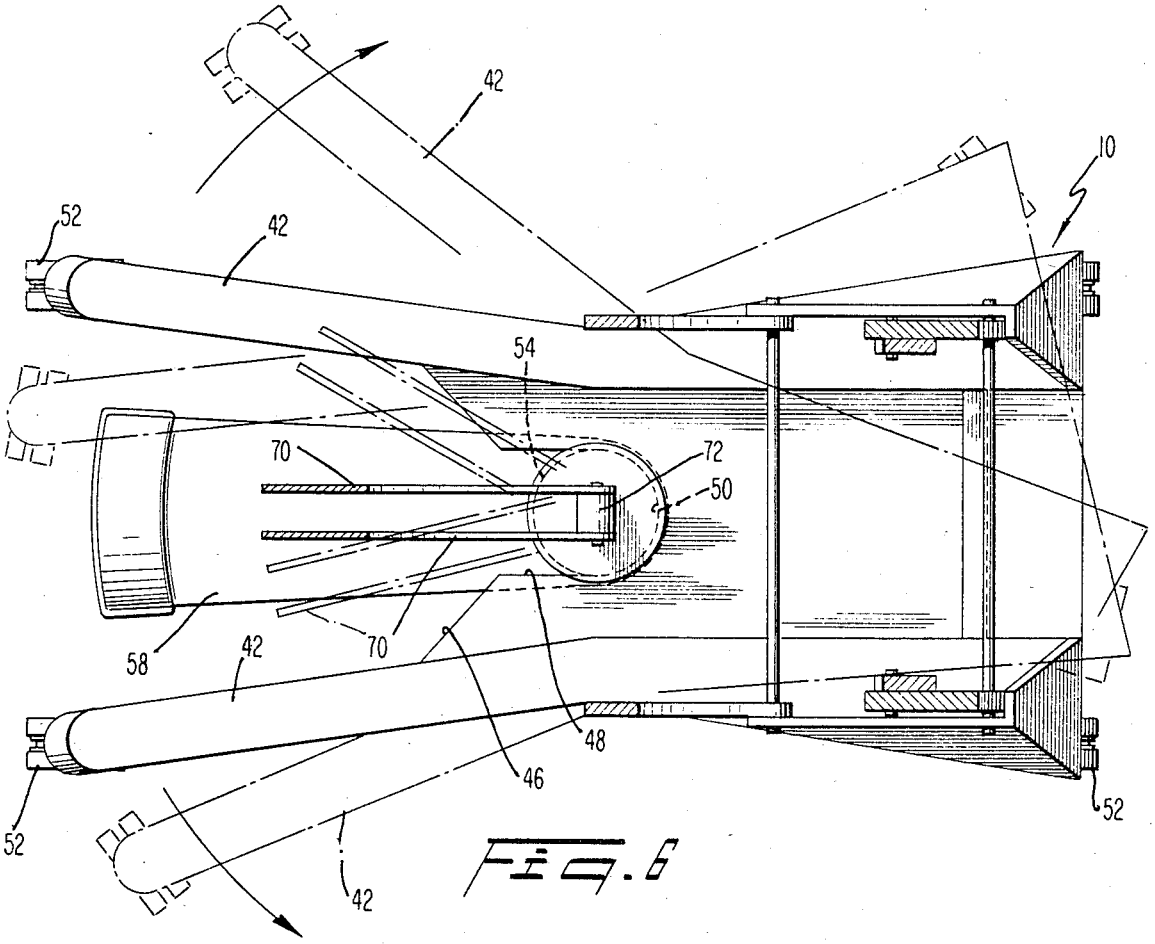
FIG. 6

Fig. 7
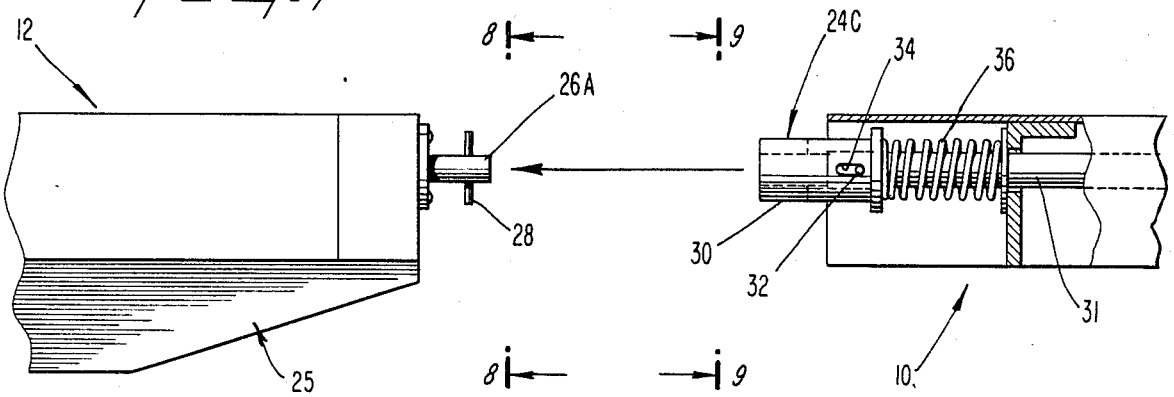
Fig. 8
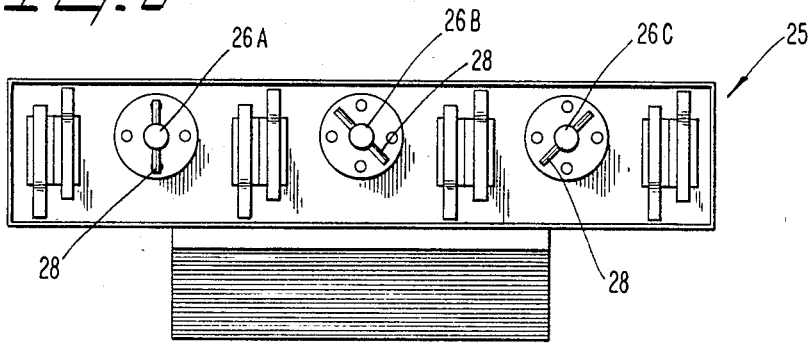
Fig. 9
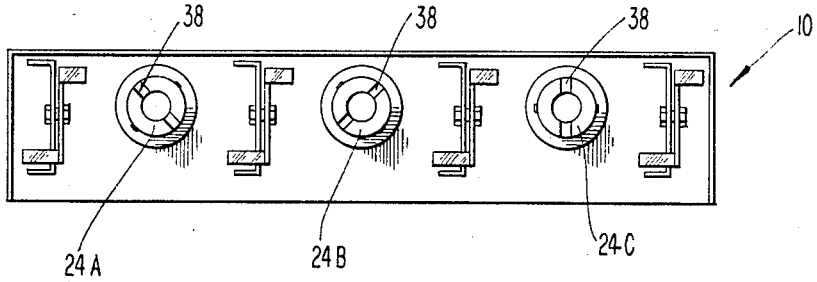
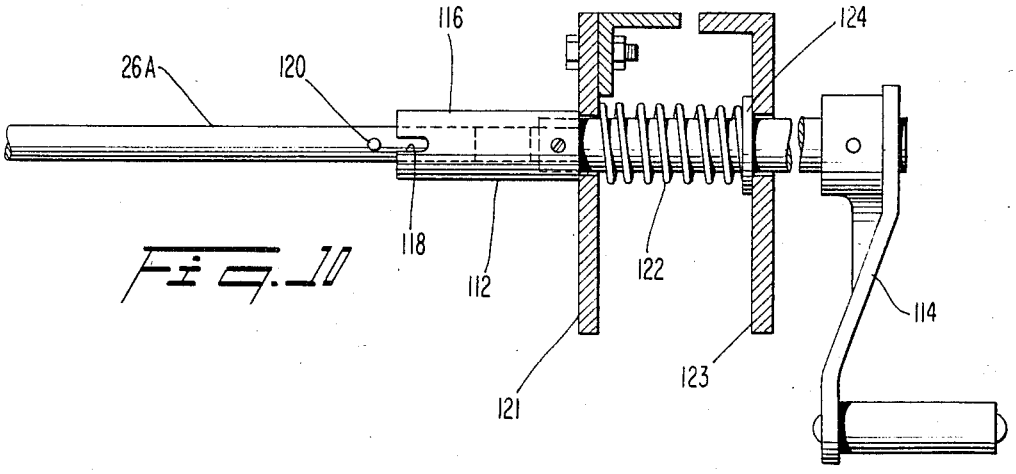
Fig. 10

HOSPITAL BED

BACKGROUND AND OBJECTS OF THE INVENTION

The present invention relates to hospital beds and, in particular, to hospital beds of the motor-driven articulated type.

Traditional hospital procedures for handling critical care or intensive care patients usually involve a number of transfers of a patient from one surface to another. For example, a critical care patient arriving at a hospital may be initially placed upon a wheeled stretcher and taken to an X-ray unit where a transfer onto an X-ray surface takes place. Additional transfers onto an operating table, weighing scale, recovery room bed, critical care bed, etc., may later be required.

The act of transferring a patient, especially a heavy patient, is difficult and can be risky to the patient as well as to the hospital personnel. Hospital personnel may encounter substantial muscle strains, while undesirable movements of the patient may complicate the patient's condition. Also, critical care patients may be accompanied by various life-sustaining devices, monitors and hanging units which may complicate and obstruct the transfer.

It is, therefore, an object of the present invention to minimize the number of transfers to which a hospital patient is subjected.

Another object is to provide a novel hospital bed which is adapted to be easily pushed and manipulated so as to render it capable of traveling to various locations in a hospital.

A further object is to provide a light-weight, yet comfortable, hospital bed upon which a patient may be easily and quickly transported and which is comfortable enough to serve as a critical or intensive care bed, and/or a recovery and extended care bed.

A further object is to provide a patient-care bed of the motor-driven articulated type in which the motors can be easily separated from the bed for maintenance purposes, or to render the bed more mobile.

A further object is to mount the motors on a quick-release, quick-insertion module which provides for self-engagement between drive and driven shafts.

Another object is to provide such a bed which enables life-sustaining equipment to conveniently accompany the patient.

SUMMARY OF THE INVENTION

These objects are achieved by the present invention which involves a drive unit for use with an articulated hospital bed having a plurality of driven shafts. The drive unit comprises a plurality of motors and drive shafts. A self-coupling mechanism is provided for making connection with driven shafts of the bed. A guide structure is engageable with the bed for aligning the drive shafts with the driven shafts. A pair of side guards are arranged to straddle the bed.

The invention is also directed to the combination of a wheeled hospital bed and a drive unit therefor. The bed comprises a plurality of articulated frame sections, a plurality of driven shafts, a linkage interconnecting the driven shafts and the frame sections for articulating the latter in response to rotation of the drive mechanism, and first guides. The drive unit includes a plurality of motors and drive shafts, and second guides arranged to interact with the first guides of the bed when the bed is merged with the drive unit in order to orient the bed and drive unit such that the driven shafts and drive shafts are mutually aligned. The drive shafts and driven shafts include a self-coupling mechanism for establishing a drive connection therebetween when in a merged condition.

The drive unit may be anchored to the floor, or may be a removable unit which is supported solely by the bed. In the former case, the bed may be arranged so as to be rotatable about a vertical axis whereby the bed can be reoriented while still in connection with the drive unit.

The drive unit may carry a pair of side guards arranged to straddle the bed. The side guards are removable and are connectible with an articulatable section of the bed so as to be movable therewith.

A wheeled cart may be provided for carrying life-sustaining devices. The cart is removable connectible to the bed for movement therewith.

THE DRAWINGS

The objects and advantages of the invention will become apparent from the following detailed description of preferred embodiments thereof, in connection with the accompanying drawings in which like numerals designate like elements, and in which:

FIG. 5 is a horizontal sectional view taken through the drive unit and bed as viewed from above, as the bed is being merged with the drive unit;

FIG. 6 is a view similar to FIG. 5, taken along the line 6—6 of FIG. 1, after the bed and drive unit have been merged together, and depicting in phantom lines some of the positions to which the bed may be swung about a vertical axis relative to the drive unit;

FIG. 7 is a side elevational view depicting a driven shaft on the bed being merged with an aligned drive shaft on the drive unit, with a portion of the bed being broken away to expose a resilient sleeve of the driven shaft;

FIG. 8 is a front elevational view of a drive section of the drive unit, taken along the line 8—8 of FIG. 7;

FIG. 9 is a front elevational view of the driven shafts of the bed, taken along the line 9—9 of FIG. 7;

FIG. 10 is a fragmentary side elevational view of a manual rotary handle disposed at a foot end of the bed for manually rotating the driven shafts;

DETAILED DESCRIPTION OF PREFERRED EMBODIMENTS OF THE INVENTION

Figure 1:
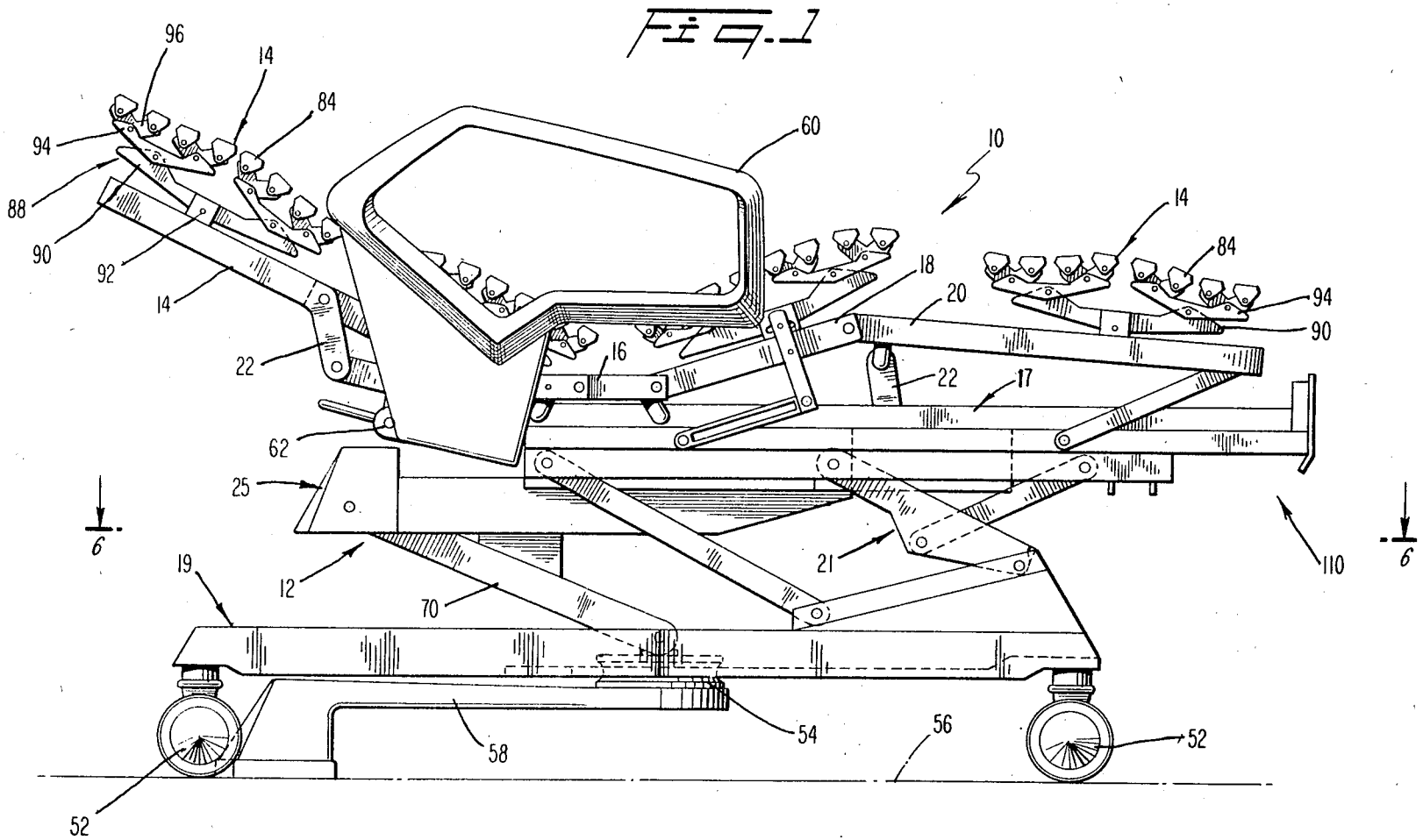
FIG. 1 is a side elevational view of a hospital bed in a merged condition with a floor-anchored drive unit according to the present invention.
Figure 2:
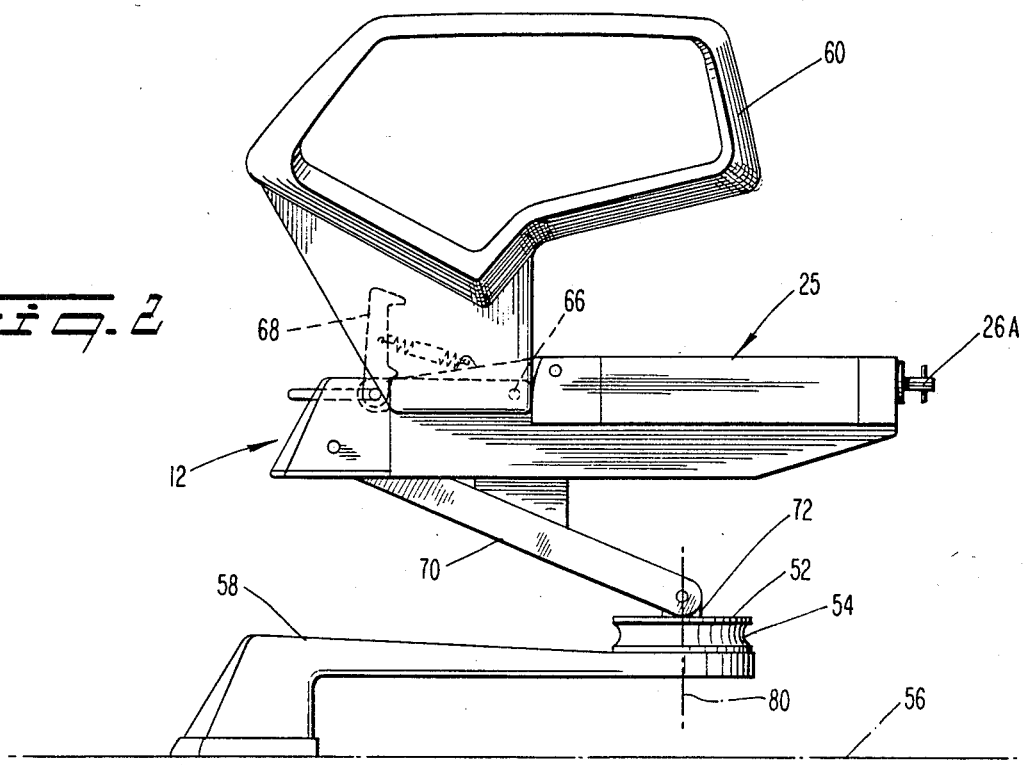
FIG. 2 is a side elevational view of a floor-anchored drive unit according to the present invention.
Figure 3:
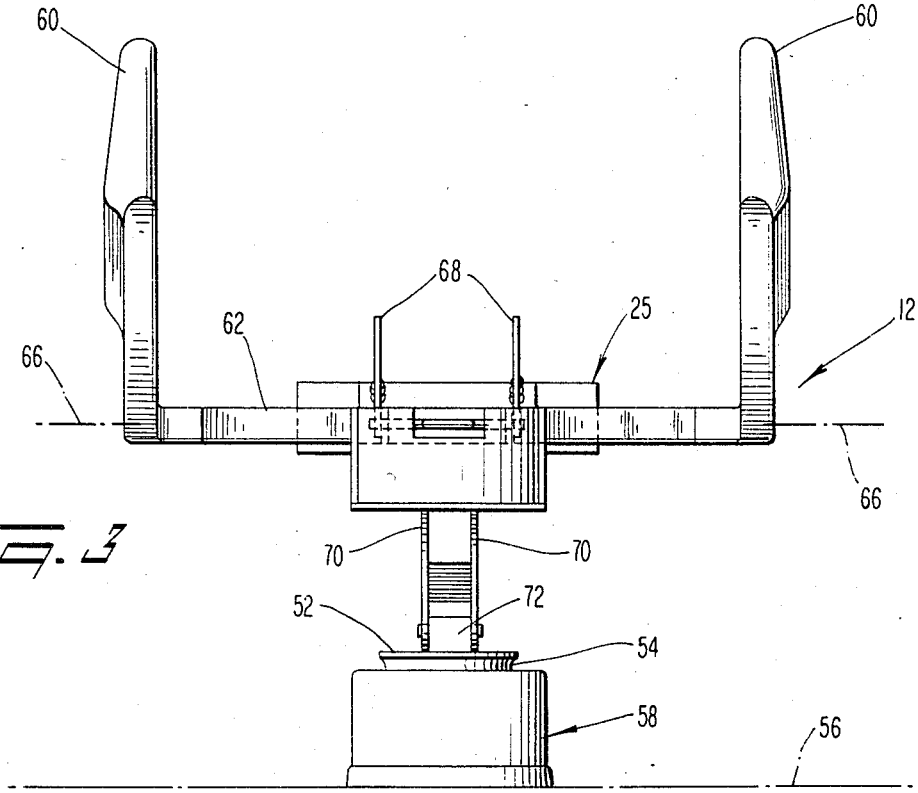
FIG. 3 is an end elevational view of the drive unit depicted in FIG. 2.

In accordance with the present invention, there is provided a hospital bed which can be selectively merged and separated with respect to a drive unit or module. In FIGS. 1–10, a drive unit 12 is depicted as anchored to the floor, and in FIGS. 11–14 another embodiment of the drive unit is depicted as being manually portable.

Referring to FIG. 1–10, a bed 10 is of the articulated type and includes a seat section 16 mounted on a sub-frame 17. A head section 14 is hinged to the seat section 16, a thigh section 18 is hinged to the seat section 16, and a foot section 20 is hinged to the thigh section 18. Standard linkage 22 extends between the sub-frame 17 and the movable sections 14, 20 for articulating the head and/or thigh and foot sections in response to rotation of one or more driven shafts 24A, B, C. The sub-frame 17 is mounted to a base 19 by means of standard linkage 21 which enables the sub-frame to be raised and lowered in a conventional manner.

In accordance with the present invention, motors for rotating the drive shafts 24A, B, C are mounted on the drive unit 12. Typically, there will be three conventional electrically operated motors contained in a drive section 25 of the drive unit 12 and each will have an exposed drive shaft 26A, B, C which carries a laterally projecting drive pin 28. The driven shafts 24A, B, C each include a movable mating sleeve 30 (FIG. 7) mounted for longitudinal sliding movement relative to a main portion 31 of the driven shaft, but fixed against rotation relative thereto by means of a pin 32 mounted on the main portion 31 and slidably disposed within a slot 34 of the sleeve. A spring 36 yieldably biases the mating sleeve 30 in an outward direction, i.e., to the left in FIG. 7. The mating sleeve 30 is of hollow cylindrical configuration and includes a longitudinally extending radial recess 38 sized to receive the drive pin 28 of a corresponding drive shaft.

The drive shafts 26A–C are located so as to be aligned with the respective driven shafts 24A–C when the bed 10 is in a docking position relative to the drive unit 12. The bed 10 and drive unit 12 include cooperating guide structure which aligns the bed 10 with the drive unit 12 as it approaches the latter. A preferred guide structure on the bed 10 comprises a horizontal guide plate 40 (FIG. 5) disposed on the base 19. The plate 40 extends between a pair of legs 42 of the base 19 and presents a forwardly opening slot 44. The front of the slot 44 is beveled, i.e., the slot includes a pair of rearwardly converging edges 46 which merge with a pair of parallel edges 48. The parallel edges 48 extend to the back of the slot which is defined by a curved edge 50 in the shape of a semi-circle. The slot 44 and diverging edges 46 are situated rearwardly of the front ends of the legs 42 so as to be located generally beneath the seat section 16 of the bed.

The cooperating guide structure on the drive unit 12 comprises a circular disk 52 having a groove 54 extending around its periphery. The groove 54 is located above the floor 56 by a distance corresponding to the height of the guide plate 40 above the floor. Therefore, the groove will receive the edges 48, 50 of the guide plate 40. The diameter of the groove 54 is approximately equal to the spacing between the parallel edges 48 of the slot as well as approximately equal to the diameter of the semi-circular back edge 50 of the slot 44. The circular disk 52 is mounted on a stationary base 58 which is fixed to the floor 56. It may be considered that the edges 46 diverge toward the disk 52, whereas the walls of the groove 54 converge toward the slot 44.

When the bed 10 is pushed toward the drive unit 12, the front edges 46 of the slot 44 in the guide plate 40 of the bed are able to align the slot with the disk 52 and thereby align the driven shafts 24A–C with the drive shafts 26A–C. That is, the edges 46 engage the groove 54 of the guide disk 52 and, if necessary, reorient the bed 10 until the parallel edges 48 of the slot 44 pass along the groove 54. When the back edge 50 of the slot 44 nests within the groove 54, the drive and driven shafts will have made contact. If any of the drive pins 28 of the drive shafts 26A–C are out of alignment with the recesses 38 of the driven shafts 24A–C, the mating sleeves 30 of the driven shafts yield resiliently against the spring 36 and remain in a yielded position until such time as the respective pins and recesses become aligned, e.g., upon start-up of the drive shafts 26A–C, whereupon the recess 38 slides over the respective pin 28 to establish a rotary drive connection therewith. It will be appreciated that, if desired, the sleeves 30 could be mounted on the drive shafts, with the pins 28 mounted on the driven shafts.

The drive unit 12 carries a pair of side guards 60 which are adapted to be swung between raised and lowered positions relative to the bed 10. Both side guards 60 are mounted on a common carrier 62 which is pivotably mounted to the drive section 25 of the drive unit 12 for swinging movement about a horizontal axis 66 disposed perpendicularly to the axes of the drive shafts. A pair of spring-biased hooks 68 are pivotably mounted on the carrier 62 at a location thereon remote from the pivotal mount. These hooks 68 are adapted to hook onto a bar 61 (FIG. 4) of the head section 14 of the bed frame when the carrier 62 is swung upwardly, to enable the side guards 60 to thereafter travel with the head section 14 as the latter is articulated. Controls for actuating the motors which articulate the various movable components of the bed may be mounted on a side guard. Other controls, e.g., for the nurse call, telephone, television, etc., may also be mounted on the side guard.

The drive section 25 of the drive unit 12 is mounted to the base 58 by means of a pair of arms 70 which extend from a bracket 72 on the circular guide disk 52. If desired, the arms 70 can be mounted for adjustment relative to the base as by being pivoted to the disk, with an extendable/retractible adjusting device such as a turnbuckle or fluid cylinder (not shown) being pivotably connected between the disk and the arms. This enables the height of the drive section 25 to be adjusted to conform to the height of the driven shafts on the bed. The guide disk 52 is rotatable about its vertical center axis 80 so that after the bed 10 has been docked with the drive unit 12, the bed can be turned about such axis 80 (FIG. 6). This is useful, for example, in situations where a patient must undergo a number of treatments; a plurality of treatment zones can be established in a room, and the patient's bed can be swung sequentially to each of those zones about the axis 80 while remaining coupled to the drive shafts.

The bed 10 is preferably of the type disclosed in copending application Ser. No. 06/454,000 filed Dec. 28, 1982 in that a plurality of lever-type force distributing assemblies 82 are provided for supporting the patient on cross slats 84, the disclosure of which is incorporated by reference herein. Each assembly 82 includes a pair of transversely spaced lever modules 88 (only one lever module 88 of each assembly 82 being depicted in FIG. 1). Each lever module includes a first lever 90 swingable about a transversely extending first axis 92 disposed intermediate the ends of the first lever, and a pair of second levers 94 pivotably mounted on the first lever at opposite sides of the first axis 92. Additionally, four third levers 96 are pivotably mounted at the ends of the second levers 94. Slats 84 are pivotably mounted at the ends of the third levers.

Such a force-distributing arrangement provides a high degree of comfort for the patient, so there is no need to employ a thick mattress. Rather, a relatively thin and light-weight foam pad can be employed instead.

It will be appreciated that a bed 10 according to the present invention which does not contain drive motors or side guards, and which carries a light-weight patient sleeping surface rather than a heavy mattress, is much lighter and mobile than a conventional motorized articulated bed and thus can be more easily moved about the hospital. Hence, a patient can be placed upon the bed at the time of entering the hospital and kept thereon through various stages of his treatment such as in the critical care, intensive care, recovery, and extended care areas of the hospital. Upon entering a new area, the bed is docked with a drive unit 12 located in that area.

As a result, the need to transfer patients from one type of bed to another is greatly reduced, thereby minimizing the strain imposed upon the patients as well as on the hospital personnel. Furthermore, it is easier to repair a malfunctioning motor, i.e., the motor is more accessible in the drive unit. Furthermore, the guide arrangement and self-coupling feature enables the removal and insertion of the drive unit to be achieved quickly and easily by non-mechanical personnel. Accordingly, if desired, the drive unit 25 can be removed from the bed in order to allow the bed to be moved to other areas of the hospital to avoid the need to effect a patient transfer. Also, by mounting the side guards 60 on the drive unit so as to be separable from the bed, the bed becomes more maneuverable, and the side guards do not get in the way of personnel attending to the patient in non-recovery areas of the hospital.

The provision of a portable bed having a light-weight sleep surface or pad is also advantageous in that it makes possible the elimination of a patient transfer at an X-ray station. That is, in order to X-ray a critical care patient, it has been necessary to transfer the patient onto a suitably transluscent surface, whereupon a fluroscope is positioned above and below the patient. In the present bed, however, the spaced support slats 84 and support pad can be made suitably transluscent to enable the fluroscope to take an X-ray from beneath the patient. This is made possible since there are no motors or thick mattress which would interfere with the positioning and operation of the X-ray equipment from beneath.

Figure 4:
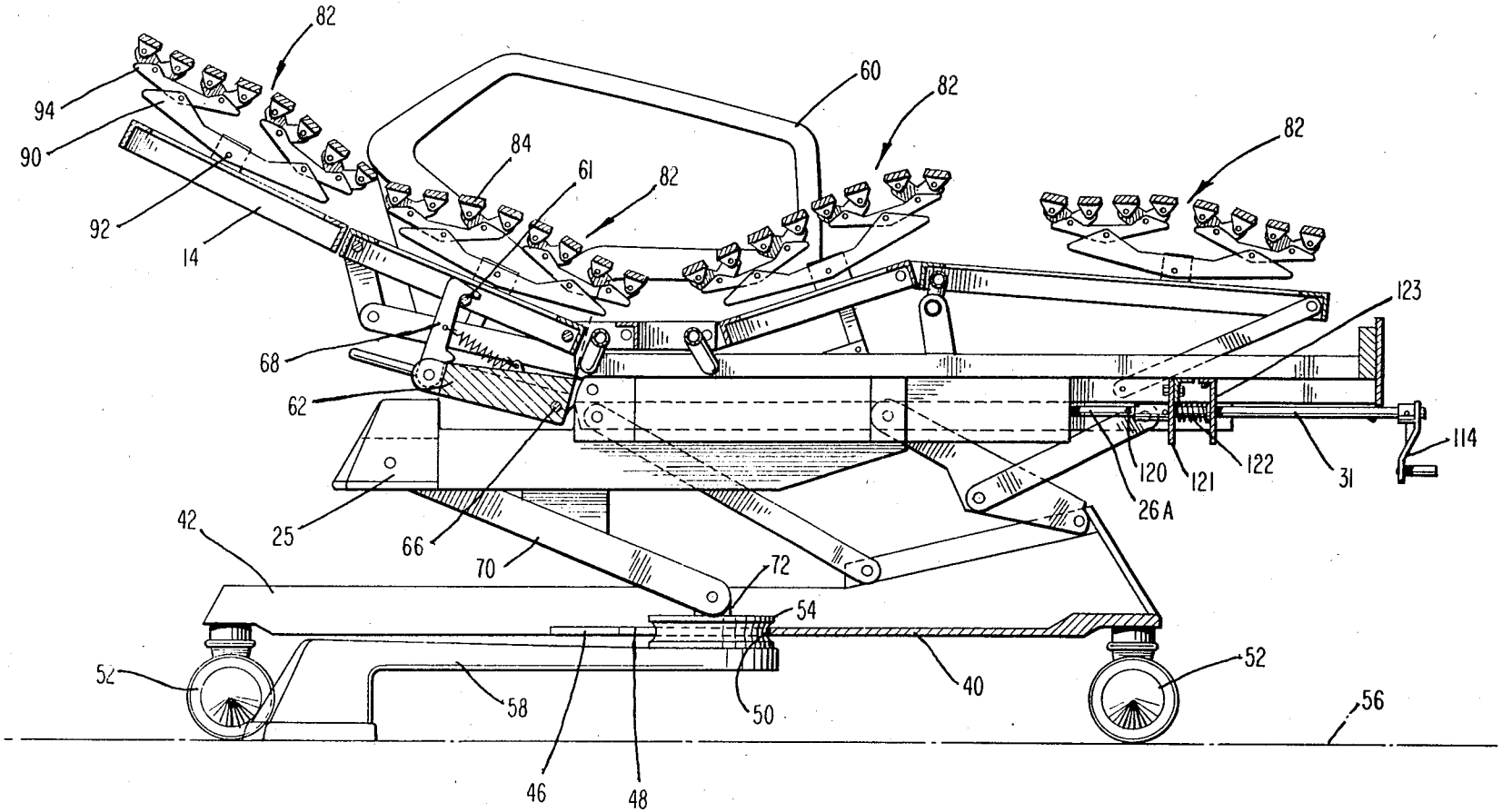
FIG. 4 is a vertical sectional view through the bed and drive unit depicted in FIG. 1.
Figure 11:
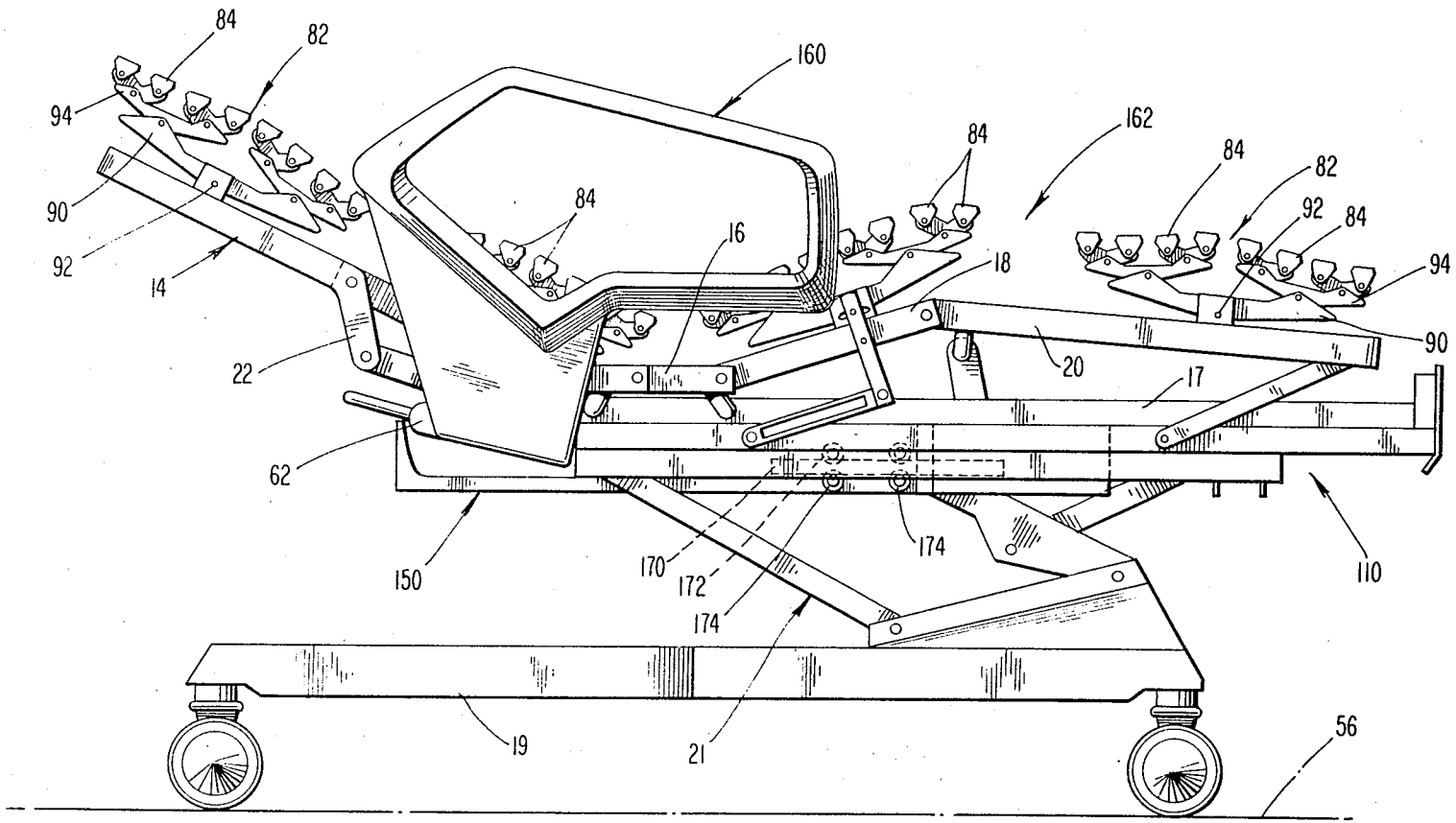
FIG. 11 is a side elevational view of a hospital bed merged together with an alternative form of drive unit of the manually portable type.
Figure 12:
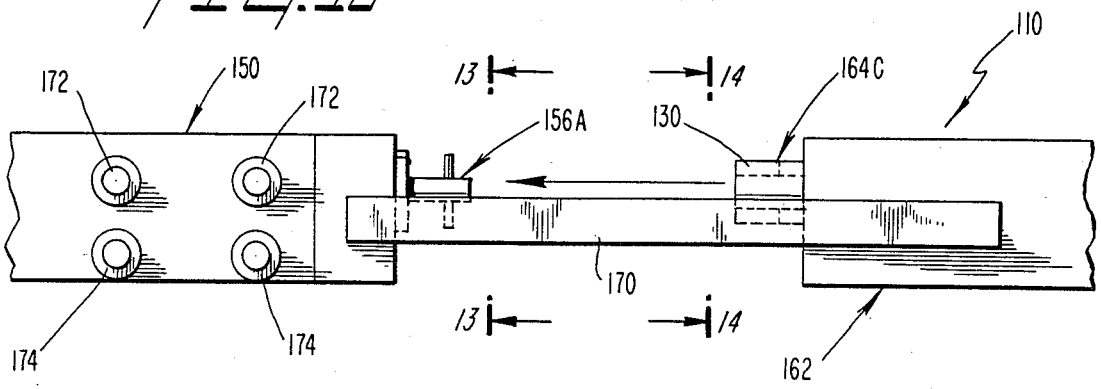
FIG. 12 is a view similar to FIG. 7 of the embodiment of FIG. 11.
Figure 13:
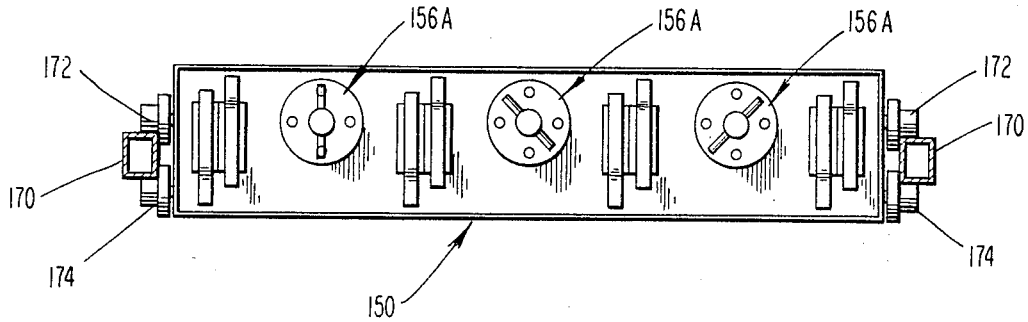
FIG. 13 is a front elevational view of the drive shafts of the embodiment of FIG. 12, taken along the line 13—13 of FIG. 12.
Figure 14:
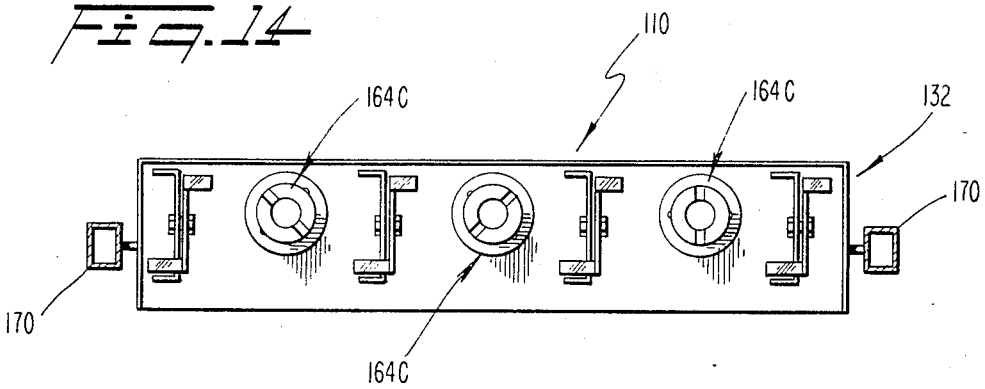
FIG. 14 is a front elevational view of the driven shafts of the FIG. 12 embodiment, taken along the line 14—14 of FIG. 12.

In the event that it is desired to articulate the bed frame at a time when the bed is not docked with a drive unit 12, i.e., is not connected to drive motors, provision is made for manual rotation of the driven shafts 26A–C. Thus, at a foot end 110 of the bed 10, there are provided a plurality of axially movable manual drive stubs 112 (FIGS. 4, 10). Each drive stub 112 is connected to a handle 114. The stub 112 includes a sleeve 116 having a notch 118. The notch is adapted to receive a pin 120 mounted on an end of the respective driven shaft 26A. The stub 112 is spring-biased away from the pin 120 by a coil spring 122 which is disposed between frame elements 121, 123 of the bed and acts upon a washer 124 affixed to the stub shaft. By pushing inwardly upon the handle 114 and rotating same, the notch will receive the pin 120 to establish a rotary drive connection between the handle and the driven shaft 26A. Other types of arrangements for connecting the stub shaft with the driven shaft are possible, such as an arrangement wherein the handle can be pivoted to an out-of-the-way position beneath the bed.

In another preferred embodiment of the invention, depicted in FIGS. 11–14, a drive unit 150 is not anchored to the floor, but rather is supported solely by the bed 162 and is removable therefrom. The drive unit 150 is similar to the drive section 25 of the earlier-described drive unit 12, in that it includes drive motors, drive shafts 156A rotated by the motors, and a pair of side guards 160. The drive shafts 156A are connectible to the spring-biased mating sleeves 130 of the driven shafts 164C in a self-coupling manner, i.e., in response to merging of the bed and drive unit or upon initial start-up of the drive shafts, in the same manner as that described earlier in connection with the shafts 26A, 24C.

The bed 162 carries a pair of horizontal guide tracks 170 which extend in parallel fashion beyond the driven shafts 164C. In corresponding fashion, the drive unit 150 carries upper and lower pairs of freely rotatable guide wheels 172, 174. The wheels of the upper pair 172 are spaced apart from the wheels of the lower pair 174 by a distance slightly greater than the vertical dimension of the track, such spacing being aligned horizontally with the track so that the upper wheels ride upon the track 170 when the drive unit is installed into the bed. Of course, the wheels and tracks define a guide arrangement which assures that the drive and driven shafts 156A and 164C are automatically aligned when the drive unit is installed.

The drive unit 150 can be installed and removed manually. This facilitates repair of the drive mechanism, because the malfunctioning drive unit 150 can be replaced by a functioning drive unit while the former is being serviced in a shop.

Figures 15, 16:
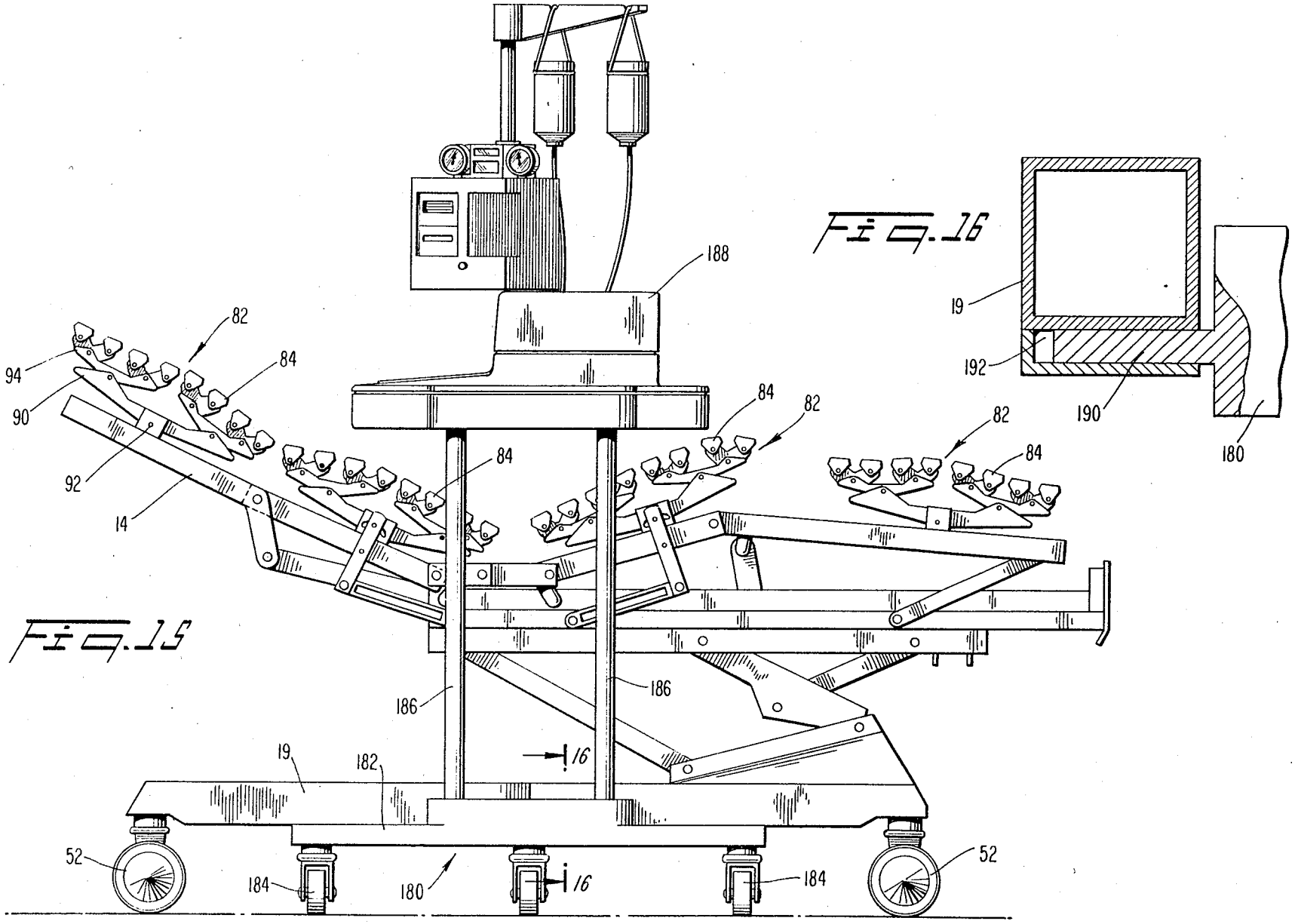
FIG. 15 is a side elevational view of a hospital bed according to the present invention, with a wheeled cart attached for common movement with, the wheeled cart carrying various life-sustaining devices.
FIG. 16 is a fragmentary cross-sectional view taken along line 16—16 of FIG. 15, illustrating the manner in which the cart is coupled for movement with the bed.

In order to facilitate the transportation of life-sustaining devices along with the patient, there is provided an equipment cart 180 (FIGS. 15, 16) which is adapted to be coupled to the bed 10 (or 162) for travel therewith. The cart includes a base 182 having a plurality of caster wheels 184. A pair of upright poles 186 are mounted on the base 182 and carry a work table 188. The base 182 is mountable to the bed 10 by a tongue and slot connection (FIG. 15). That is, the base 182 carries a tongue 190 which is insertable into a slot 192 of the bed in order to couple the cart to the bed for movement therewith. Any desired life-sustaining devices can be carried on the cart such as IV bottles, volumetric/pump, oxygen gauges, oxygen tank, etc.

In practice, the bed 10 or 162 can be utilized in the usual fashion while connected to the drive unit 12 or 150. That is, the bed can remain at a pre-selected location within the hospital room. In such a case, the drive unit offers the advantage of facilitating maintenance and repair of the drive motors.

Alternatively, however, the drive unit 12 or 150 can be mutually separated from the bed 10 or 162, whereby the bed is rendered highly mobile in the absence of the bulk and weight of the motors and side guards. This enables the bed to be transported to various areas within the hospital so as to minimize the number of patient transfers which need to be made.

When converging the drive unit 12 or 150 with the bed, the cooperating guide structures on the bed and drive unit (i.e., the slot 44 and the disk 52, or the wheels 172 and the track 170) align the driven and drive shafts. The self-coupling mechanism 28, 30 or 130 assures that the drive and driven shafts will become rotatably coupled in response to merging of the bed and drive unit, either before or upon the initial start-up of the drive motors.

The ability of the bed 10 to swing about the vertical axis 80 of the drive unit enables the bed to be moved to a number of positions within a given room while maintained in connection with the drive unit.

An advantage of employing a floor-mounted driving unit 12 is that there is no need to tailor the design of the bed to the particular stage of treatment to which the patient is subjected. That is, it is presently customary for the bed controls at one treatment stage (e.g., an emergency room where a nurse or doctor has access) to be located differently from those at another treatment stage (e.g., a general care room where the patient has access). Hence, different types of beds must be purchased. However, in accordance with the present invention, only one type of bed need be purchased; any modification as regards controls location can be accomplished by the purchase of different types of drive units 12.

Although the present invention has been described in connection with preferred embodiments thereof, it will be appreciated by those skilled in the art that additions, modifications, substitutions, and deletions not specifically described may be made without departing from the spirit and scope of the invention as defined in the appended claims.

What is claimed is:

1. In combination, a wheeled hospital bed and a drive unit supported solely by said bed, said bed comprising a plurality of articulated frame sections, at least one rotatably driven shaft, linkage means interconnecting said driven shaft and said frame sections for articulating the latter in response to rotation of said drive shaft, and first guide means, said drive unit including at least one motor and rotatable drive shaft, and second guide means arranged to interact with said first guide means of said bed when said bed is merged horizontally with said drive unit in order to orient said bed and drive unit such that said driven shaft and drive shaft are mutually aligned, said drive shaft and driven shaft including self-coupling means for establishing a drive connection therebetween in response to relative horizontal movement between said drive shaft and said driven shaft when said bed is merged with said drive unit, one of said first and second guide means comprising rotary mounted wheels, and the other of said first and second guide means comprising a track engageable with said wheels.

2. The combinatioin according to claim 1, wherein said drive unit carries a pair of side guards arranged to straddle said bed.

3. The combination according to claim 2 including means for interconnecting said side guards to an articulatable section of said bed so that said side guards travel with said last-named section as the latter is articulated.

4. The combination according to claim 1, wherein said bed comprises a plurality of support assemblies mounted on each of said frame sections and spaced apart in the fore-aft direction of said bed, each support assembly comprising a plurality of elongate slats extending transversely of said fore-aft direction and spaced apart in said fore-aft direction, and a pair of transversely spaced lever modules carrying opposite ends of said slats, each lever module comprising a first lever swingable about a transversely extending first axis disposed intermediate its ends, and a pair of second levers mounted on said first lever on opposite sides of said first axis, each of said second levers being swingable relative to said first lever about a transversely extending second axis disposed intermediate its ends, the first and second levers of each lever module of said pair of modules being swingable relative to the corresponding first and second levers, respectively, of the other lever module of said pair.

5. The combination according to claim 1, wherein said driven shafts include remote ends disposed opposite the ends which connect with said drive shafts, a plurality of manually rotatable handles mounted on said bed adjacent said remote ends of said driven shafts and being connected to drive stubs, said handles being movable to shift the associated drive stubs into engagement with respective ones of said driven shafts, said drive stubs and said driven shafts including self-coupling means.

6. The combination according to claim 1, wherein said self-coupling means comprises projections on one of said drive shafts and said driven shafts and recesses on the other of said drive shafts and driven shafts for receiving said projections to establish a drive connection between said drive shafts and driven shafts, one of said projections and recesses being resiliently yieldable to enable said drive shafts and driven shafts to be brought together when said projections and recesses are non-aligned.

7. The combination according to claim 6, wherein said one of said projections and recesses being mounted on a movable sleeve, and spring means engaging said sleeve for permitting said sleeve to yield resiliently.

8. The combination according to claim 1 further including a wheeled cart for carrying life-sustaining devices, said cart being removably connectible to said bed for movement therewith.

9. A drive unit for use with an articulated hospital bed of the type which is movable within a room and which has at least one horizontal rotatably driven shaft, said drive unit separate from said bed and anchored to a stationary surface of the room at a location where the bed is to be disposed and comprising:

at least one motor and rotatable horizontal drive shaft, self-coupling means arranged to receive and connect with said horizontal driven shaft of the bed solely in a horizontal direction, guide means engageable with the bed for aligning said drive shaft with the driven shaft, and a pair of side guards arranged to straddle the bed.

10. A drive unit according to claim 9, wherein said side guards are pivotable and carry connecting means for interconnecting said side guards to an articulated section of the bed for movement therewith.

11. A drive unit according to claim 9, wherein said drive unit comprises a stationary base and a drive section carrying said drive shafts and motors, said drive section being mounted on said base for rotation relative thereto about a vertical axis to enable the bed to rotate about said vertical axis with said drive shafts connected to the driven shafts.

12. In combination, a hospital bed and a drive unit therefor, said bed comprising a wheeled base portion movable within a room, a plurality of articulatable frame sections mounted on said base portion, and at least one rotatably driven shaft connected to said frame sections to articulate the latter, said drive unit being separate from said bed and anchored to a stationary surface of the room at a location in which the bed is to be disposed and comprising at least one motor and rotatable drive shaft driven by said motor, said bed and drive unit comprising mutually engageable first and second guide means which produce alignment of said drive shaft and driven shaft with said bed being in a position pushed horizontally against said drive unit, said drive shaft and driven shaft including self-coupling means arranged to become intercoupled for establishing a drive connection therebetween solely in response to relative horizontal movement between said drive shaft and said driven shaft as said bed is being merged with said drive unit, said drive unit including a pair of side guards arranged to straddle said bed, said side guards being movably mounted on said base, and means for connecting said side guards to one of said articulatable sections of said bed so that said side guards move with such articulatable section.

13. In combination, a hospital bed and a drive unit therefor, said bed comprising a wheeled base portion movable within a room and a plurality of articulated frame sections, at least one rotatably driven shaft, linkage means interconnecting said driven shaft and said frame sections for articulating the latter in response to rotation of said driven shaft, said drive unit being separate from said bed and comprising a base stationarily anchored to a stationary surface of the room at a predetermined location in which the bed is to be disposed and a drive section mounted on said base, said drive section carrying at least one motor and drive shaft rotatably driven thereby, self-coupling means to connect said drive shaft with said driven shaft solely in response to relative horizontal movement between said drive shaft and said driven shaft as said bed is being merged with said drive unit, said drive section being mounted on said base for rotation relative thereto about a vertical axis such that said bed and drive section can be rotated relative to said base about said axis with said drive and driven shafts connected together.

14. In combination, a hospital bed including wheels enabling said bed to be moved within a room and a drive unit separate from said bed and anchored to a stationary surface of the room at a location in which the bed is to be disposed, said bed comprising a plurality of articulated frame sections, at least one rotatably driven shaft, linkage means interconnecting said driven shaft and said frame sections for articulating the latter in response to rotation of said driven shaft, and first guide means, said drive unit including at least one motor and rotatable drive shaft, and second guide means arranged to interact with said first guide means of said bed when said bed is merged with said drive unit in order to orient said bed and drive unit such that said driven shaft and drive shaft are mutually aligned, said drive shaft and driven shaft including self-coupling means arranged to become intercoupled for establishing a drive connection therebetween solely in response to relative horizontal movement between said drive shaft and said driven shaft when said bed is merged with said drive unit.

15. In combination, a wheeled hospital bed and a drive unit, said bed comprising a plurality of articulated frame sections, at least one rotatably driven shaft, linkage means interconnecting said driven shaft and said frame sections for articulating the latter in response to rotation of said driven shaft, and first guide means, said drive unit including at least one motor and rotatable drive shaft, and second guide means arranged to interact with said first guide means of said bed when said bed is merged with said drive unit in order to orient said bed and drive unit such that said driven shaft and drive shaft are mutually aligned, said drive shaft and driven shaft including self-coupling means arranged to become intercoupled for establishing a drive connection therebetween solely in response to relative horizontal movement between said drive shaft and said driven shaft as said bed is being merged with said drive unit, said drive unit carrying a pair of side guards arranged to straddle the bed.

16. In combination, a wheeled hospital bed and a drive unit, said bed comprising a plurality of articulated frame sections, at least one rotatably driven shaft, linkage means interconnecting said driven shaft and said frame sections for articulating the latter in response to rotation of said driven shaft, and first guide means, said drive unit including a plurality of motors and rotatable drive shaft, and second guide means arranged to interact with said first guide means of said bed when said bed is merged with said drive unit in order to orient said bed and drive unit such that said driven shaft and drive shaft are mutually aligned, said drive shaft and driven shaft including self-coupling means for establishing a drive connection therebetween in response to relative horizontal movement between said drive shaft and said driven shaft when said bed is merged with said drive unit, said driven shaft including a remote end disposed opposite the end which connects with said drive shaft, a manually rotatable handle mounted on said bed adjacent said remote end of said driven shaft and being connected to a drive stub, said handle being movable to shift the drive stub into engagement with said driven shaft, said drive stub and said driven shaft including self-coupling means.

* * * * *